United States Patent [19]

Gross et al.

[11] 4,133,318

[45] Jan. 9, 1979

[54] WATER PIPE

[76] Inventors: Ronald Gross, 2134 W. Weldon Ave.; Jimmy L. Whitfill, 2407 W. Weldon Ave., both of Phoenix, Ariz. 85015

[21] Appl. No.: 808,110

[22] Filed: Jun. 20, 1977

[51] Int. Cl.[2] ..... A24F 1/14; A24F 1/30

[52] U.S. Cl. ..... 131/173; 131/185; 131/193; 131/223

[58] Field of Search ..... 131/173, 185, 171 R, 131/178, 193, 215 R, 223, 9, 10

[56] References Cited

U.S. PATENT DOCUMENTS

| | | | |
|---|---|---|---|
| 2,825,342 | 3/1958 | Wang | 131/223 X |
| 3,804,100 | 4/1974 | Fariello | 131/173 |
| 3,889,690 | 6/1975 | Guarnieri | 131/173 X |
| 3,918,464 | 11/1975 | Kolodzies | 131/173 |

*Primary Examiner*—Stephen C. Pellegrino
*Attorney, Agent, or Firm*—Warren F. B. Lindsley

[57] ABSTRACT

A tubular water pipe embodying an electrical heating element in its base operable by use of a momentary on/off switch forming a part thereof and divided into separate chambers. The lower chamber collects smoke of a burning product such as tobacco and the upper chamber containing water cools the smoke when drawn therethrough by the smoker.

11 Claims, 9 Drawing Figures

WATER PIPE

BACKGROUND OF THE INVENTION

This invention relates to a water pipe for smoking organic materials such as tobacco which may be hot, harsh and irritating to the lungs of the smoker. Water pipes include a water chamber between the bowl wherein the substance being smoked is burned and a mouthpiece through which the smoke is drawn. Smoke bubbles through the water and is cleaned of ash and contaminants while being cooled, thereby rendering the smoking habit less irritating to the lungs of the smoker.

Description fo the Prior Art

In the tobacco pipe art, many attempts have been made to provide a heating or ignition element within the bowl of the pipe so that matches, lighters and other ignition means separate from the pipe are not required.

U.S. Pat. No. 1,157,771 shows an ordinary pipe having a heating element extending through a bottom portion of a tobacco receiving bowl adapted to be connected to an electrical source.

U.S. Pat. No. 3,402,723 discloses a heating element and a rechargeable battery within the bowl of the pipe. The rechargeable battery is recharged between use by mating contacts in a pipe stand.

U.S. Pat. Nos. 3,881,499; 3,889,690 and 3,918,464 disclose pipes using a cooling liquid for the smoke prior to receiving the lips of the smoker. None, however, disclose in a single simple unitary structure the heating unit as well as the cooling liquid. Further, the cleaning and servicing of the prior art pipes are cumbersome and distracting from its acceptance and use.

SUMMARY OF THE INVENTION

In accordance with the invention claimed, as improved tubular two-piece water pipe is provided employing a removable electric heating element in the lower portion thereof the energization thereof being easily controlled by an on/off switch. The smoke of the burning material is drawn through a one-way valve, and a column of coolant to the smoker thereby cleaning and cooling the smoke before it reaches the smoker.

It is, therefore, one object of this invention to provide an improved water pipe.

Another object of this invention is to provide a tubular water pipe containing the heating element for consuming the burnable material and the smoke coolant all in a unitary structure.

A further object of this invention is to provide a tubular water pipe comprising at least two parts which may be readily disassembled to clean out the ashes of the bowl without disturbing the smoke coolant in the other separable part of the pipe.

A still further object of this invention is to provide an improved tubular two-piece water pipe containing a bowl for the burning material and its ash immediately above the heating element of the pipe.

A still further object of this invention is to provide an improved water pipe containing a normally open switch the closing of which may be selectively controlled for heating the burnable substance.

A still further object of this invention is to provide an improved water pipe which eliminates the internal and external tubing of the prior art.

A still further object of this invention is to provide a dual purpose water pipe which may also serve as a table cigarette and cigar lighter.

Yet another object of this invention is to provide a water pipe which may serve as an inexpensive respiratory inhaler.

Further objects and advantages of this invention will become more apparent as this description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
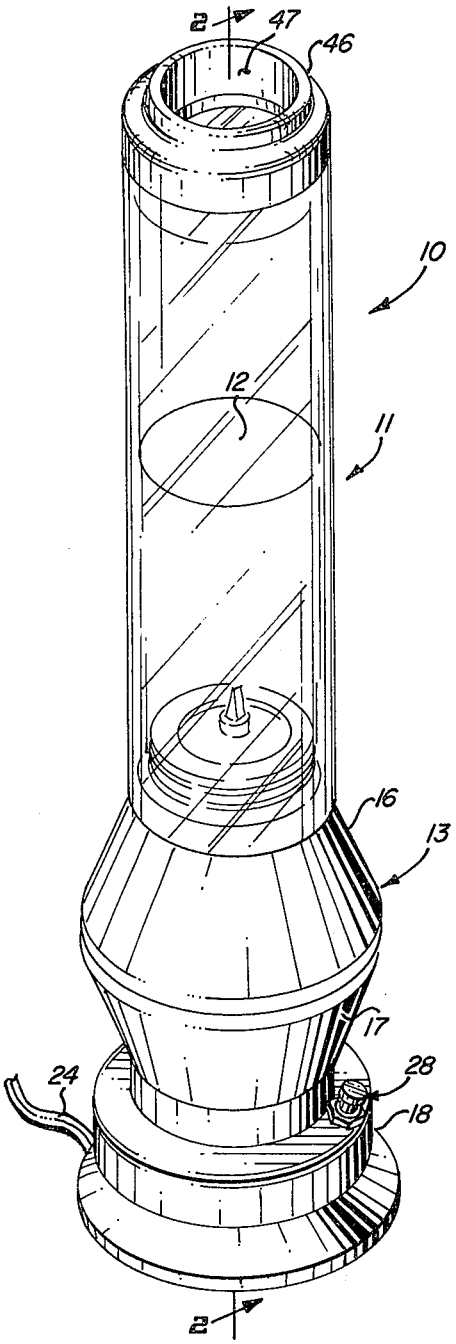
FIG. 1 is a perspective view of a water pipe embodying the invention.
Figure 2:
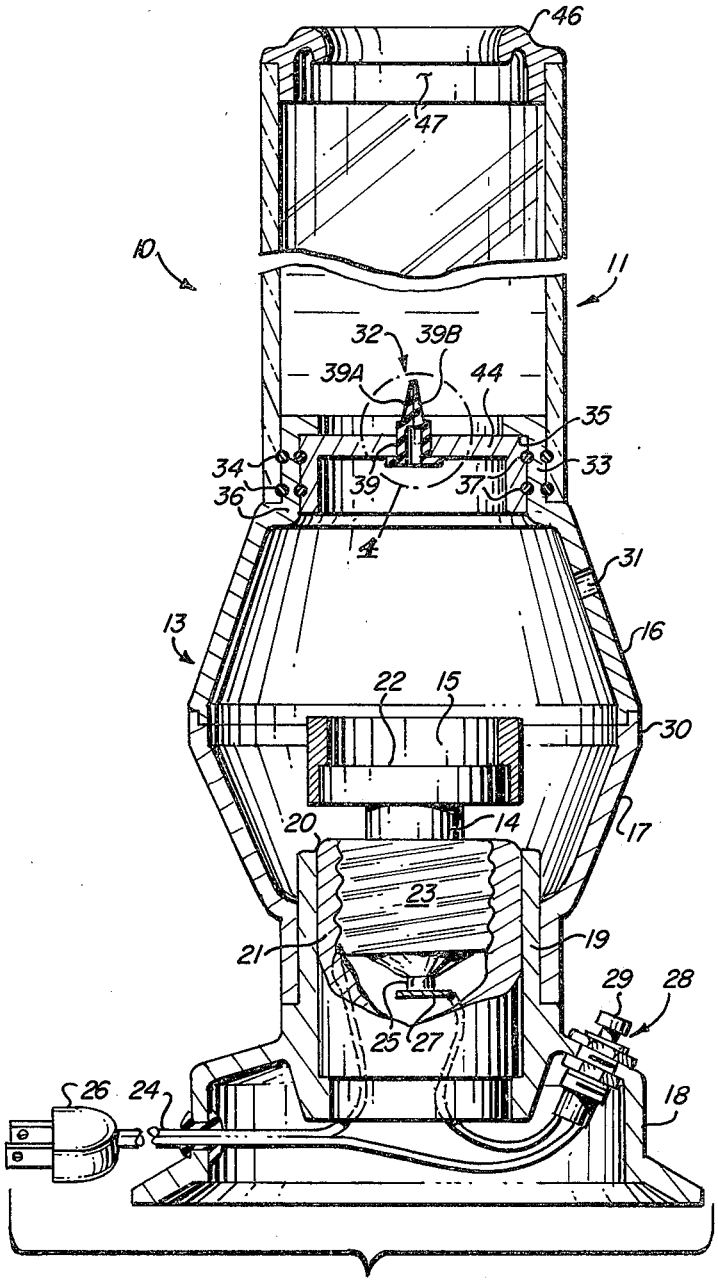
FIG. 2 is a cross-sectional view of FIG. 1 taken along the line 2—2.

Referring more particularly to the drawings by characters of reference, FIGS. 1–4 disclose a water pipe 10 divided into an upper inhalation and water chamber 11, partially filled with water 12 or other suitable coolant liquid and a lower chamber 13 containing an organic heating element 14 for tobacco or the like and a bowl 15 to contain the burnable material or the like. It should be noted that the upper chamber may be tubular, as shown in FIGS. 1 and 2, with the lower chamber a bowed-out tubular configuration containing two converging outwardly extending parts 16 and 17, each comprising a frustum of a cone which engages or interlocks at their greatest diameter, as shown in FIG. 2.

The lower part 17 of the bowed-out tubular configuration is snugly fitted to or formed integral with a base structure 18. This base structure is intended to be positioned on a supporting surface for holding erect and supporting the parts of the water pipe. This base structure is provided with an upstanding hollow tubular collar 19 into the open end 20 of which is secured an internally threaded socket 21 which is adapted for receiving in mating threaded arrangement the heating element 14.

Figure 3:
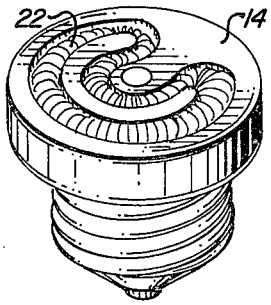
FIG. 3 is a perspective view of the removable plug-type heating element shown in FIGS. 1 and 2.

The heating element may comprise, as shown in FIGS. 2 and 3, a plug-type element having a heating unit or wire 22 placed across its upper surface to act when energized as a hot plate or burner. The plug-type element, like most fuse devices, has an outer conductive threaded shell 23 connected to one wire of a 110 or 120 volt power line 24 and a centrally located electrode 25 connected to the other wire of the power line 24 terminating in the usual wall plug 26. The electrode 25 of the heating element 14 is connected through a spring contact 27 to a suitable switch 28 mounted in the base structure 18 which form an on/off switch between the power line 24 and the heating element 14 all comprising a well-known wiring connection for a heating element.

Although switch 28 may be of any suitable type, it is preferable in this installation to be a normally off or open switch which is temporarily closed by finger pressure on a knob 29 which completes the electric circuit through the heating element only when pressure is applied to knob 29 of the switch thereby eliminating the possibility of unintentionally energizing the heating element.

As shown in FIG. 2, bowl 15 sets immediately on top of the plate or wire 22 of the heating element and the burnable substance placed in the bowl may be readily burned to its ash upon the energization of the heating element.

It should be noted that the bowed-out configuration 13 may interlock by a friction interlocking finger configuration 30 at the widest part thereof, as shown, or at any other position along its length. One of the parts 16 and 17 should be provided with an air passageway 31 and part 16 is shown as containing it for the introduction of air into the pipe for supporting combustion of the burnable material.

The substance to be burned is placed in bowl 15 mounted on the heating element 14 and the fumes (combustion products) are conveyed into the water chamber 11 through a one-way valve 32.

As noted from FIG. 2 of the drawing, the water chamber 11 frictionally engages with a collar 33 on the upper part 16 of the bowed-out configuration of the lower chamber 13 of the water pipe and is held in water engagement therewith by suitable means such as a pair of O-rings 34 positioned within and between the lower end of water chamber 11 of the outer side surface of collar 33.

The water pipe shown in FIG. 2 is so designed that its collar 33 is flared inwardly to provide a ledge or seat 35 against which a U-shaped plate 36 is frictionally held by a pair of O-rings 37. This plate is provided with an aperture 38 for receiving the one-way valve 32.

Figure 4A:
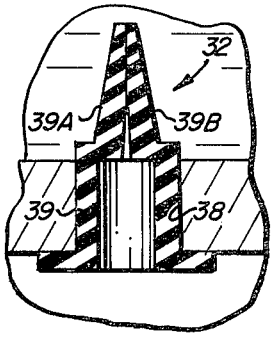
FIG. 4A is an enlarged cross-sectional view of the structure shown in the circle number 4 in FIG. 2 in valve closed position.
Figure 4B:
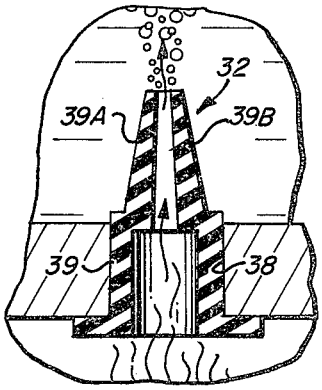
FIG. 4B is a view similar to FIG. 4A showing the valve in its open position.

The one-way valve 32 comprises a resilient grommet 39 having a pair of resilient lips 39A and 39B biased toward each other closing the valve under atmospheric pressure in the manner shown in FIG. 4A. Under pressure of the burning material and/or suction pressure of the smoker the lips 39A and 39B are forced open, as shown in FIG. 4B, to cause the hot gases of the burning material to pass through the valve with the lips closing upon reduction in pressure.

Figure 5:
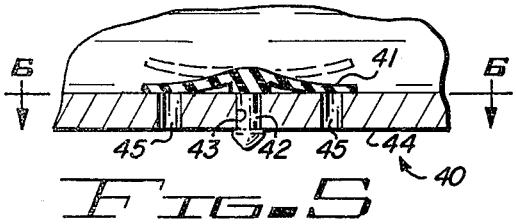
FIG. 5 is a modification of the one-way valve shown in FIGS. 4A and 4B.
Figure 6:
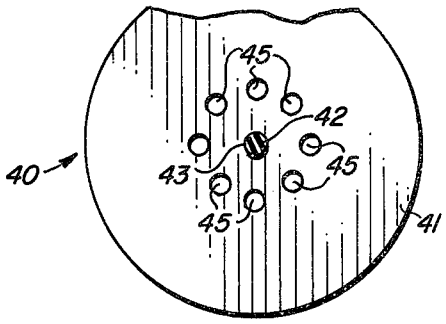
FIG. 6 is a cross-sectional view of the valve shown in FIG. 5 taken along the line 6—6.

FIGS. 5 and 6 illustrate a modification of the one-way valve 32 shown in FIGS. 1-4, wherein the one-way valve 40 comprises a resilient sheet of material 41 having a centrally positioned prong 42 which frictionally fits into and interlocks with an aperture 43 extending through the bite 44 of the U-shaped plate 36. Spacedly positioned around aperture 43 is a plurality of apertures or passageways 45 which are normally closed under atmospheric pressure by material 41 and opened when the pressure in the lower chamber 13 under combustion conditions exceeds atmospheric pressure.

Thus, it should be noted that ashes, smoke, gases and other contaminants drawn from the burning substance in bowl 15, by reason of the smoker's inhalation on the mouthpiece 46 frictionally inserted into the open end 47 of the water chamber 11 of the water pipe will be drawn from the lower chamber 13 through the one-way valve 32 or 40 passing upwardly in the pipe through the coolant or water 12 and mouthpiece 46 into the mouth of the smoker.

As a result of the suction created by the mouth of the smoker, i.e. the low pressure above the water level in chamber 11, smoke is drawn out of the lower chamber 13 bubbling up through and cooled by the water before passing into the upper portion of chamber 11 above the water and thence on to the mouth and lungs of the smoker via mouthpiece 46.

By rendering the lower chamber detachable at or near the bowl 15 level thereof the pipe may be easily disassembled to remove the ash of the burned material and add more burnable material if the pipe is to be further used at that time. Further, with the bowl in place or removed the disassembled bottom portion of the pipe may be used for a cigarette or cigar lighter.

Figure 7:
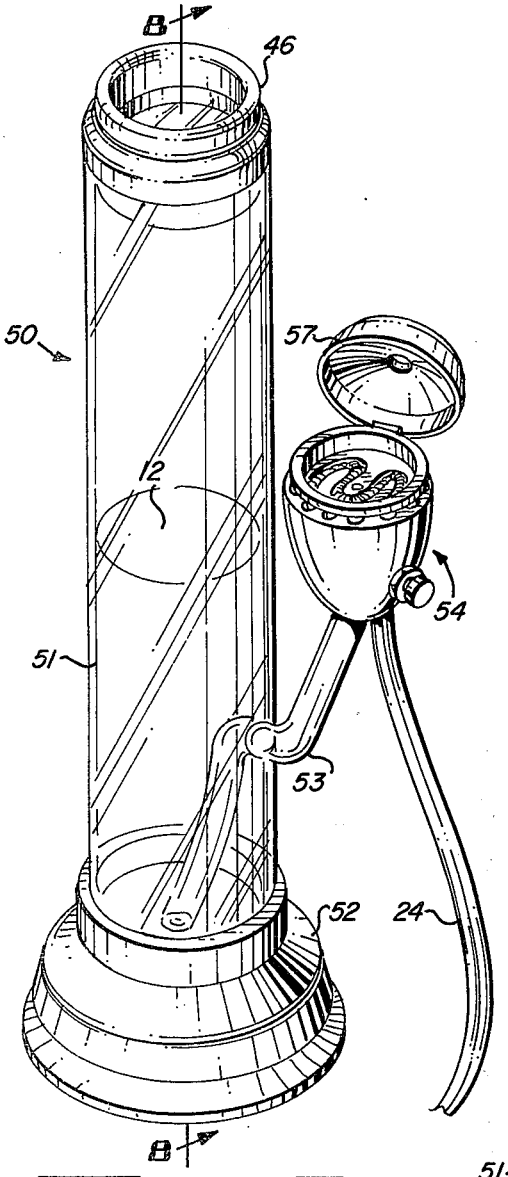
FIG. 7 is a perspective view of the water pipe shown in FIG. 1 with the heating element shown outside of a unitary tubular pipe configuration.
Figure 8:
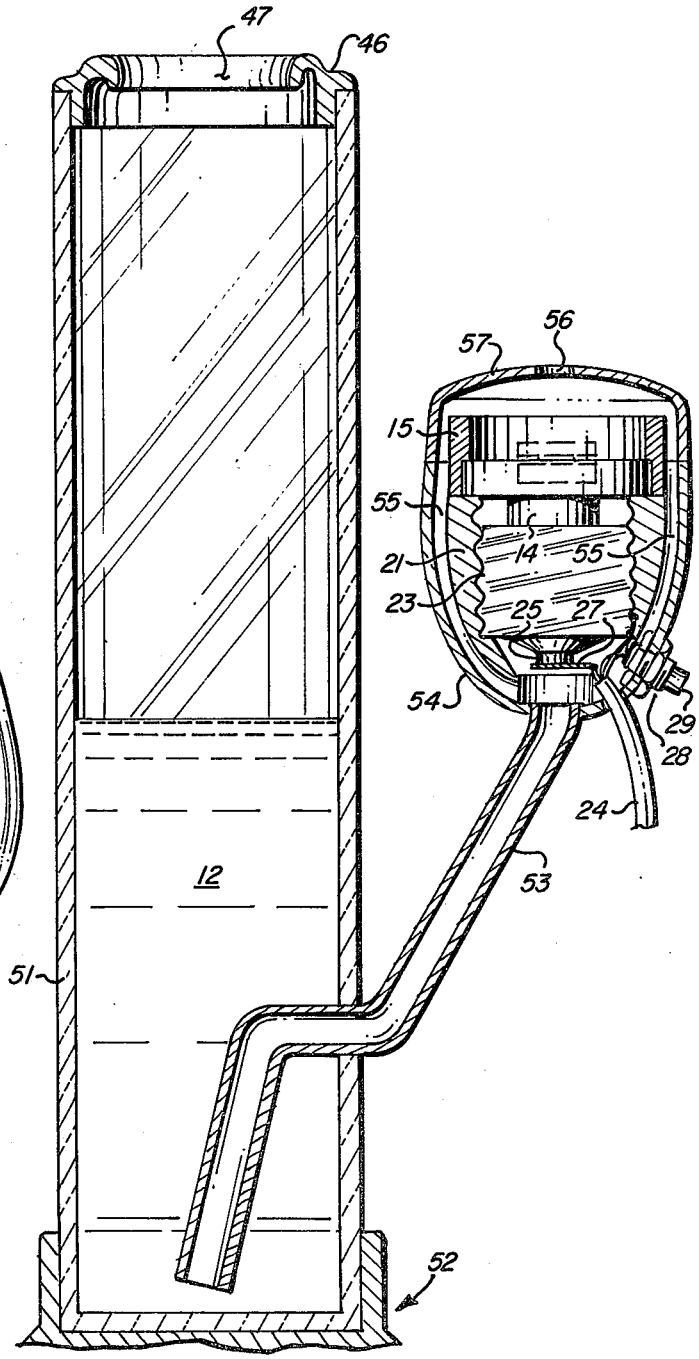
FIG. 8 is a cross-sectional view of FIG. 7 taken along the line 8—8.

FIGS. 7 and 8 illustrate a modification of the water pipe shown in FIGS. 1-6 wherein the water pipe 50 comprises a hollow tubular water chamber 51 containing a coolant such as water 12 fitted into a base structure 52 in a fluid tight arrangement and having a gas flow passageway 53 for smoke, ash, gases and the like extending from a burning unit 54 arranged outside of the water chamber but closely adjacent thereto. The burning unit 54 may comprise substantially the same socket 21, shell 23, electrode 25, spring contact 27, and the heating element 14 and bore 15, as shown in FIGS. 1 and 2, except that they are mounted in the burning unit 54.

The burning unit 54 is so arranged that the smoke, gases, ash, etc. is directed under suction of the smoker around the outside of socket 21 in a passageway 55 formed by the space between socket 21 and the inside periphery of burning unit 54 and through passageway 53 into the bottom of water chamber 51 where it bubbles up through water 12 and through the mouthpiece 46 in the same manner as described for the structure shown in FIGS. 1-4.

As noted from FIGS. 7 and 8, the burning unit 54 has an air inlet port 56 in the detachable cap 57 formed on the egg-shaped burning unit 54 and the switch 28 mounted in the bottom portion 59 of the burning unit which switch operates in the same manner as described for the structure shown in FIGS. 1-4.

Preferably, all or most of the components of the water pipes disclosed may be made of a suitable acrylic resin, such as Plexiglas, or any other suitable glass-like thermoplastic material. Although the mouthpiece is clearly illustrated as a gently contoured and rounded configuration, it may have any other suitable configuration.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Although not a modification of the water pipe, it should be noted that the burning unit can function to burn the material before and independently of any smoking of the pipe since the smoke can be collected in the burning chamber prior to smoking.

What is claimed is:

1. A tubular water pipe comprising:

a base structure comprising a first chamber containing an organic material burning unit, a second inhalation and water chamber connected at one end to said first chamber in axial alignment therewith, means separating in water tight arrangement said first and second chambers, means between said first and second chambers containing a one-way valve for transferring gas created by the burning of the material in said first chamber into said second chamber, an organic material burning unit mounted in said first chamber, said burning unit comprising an electric heating element and a bowl in heat transfer relationship, said bowl being provided for holding the material to be burned, an electric switch means mounted on said water pipe and connectable to an electric source for selectively energizing said heating element, and a mouthpiece mounted on the other end of said second chamber, whereby suction applied by a smoker to the mouthpiece draws gases of the burning material passing through said one-way valve and the water into the mouth of the smoker.

2. The tubular water pipe set forth in claim 1 wherein:

said first chamber comprises two detachable coaxially arranged parts which may be separated to expose said bowl for loading and cleaning purposes.

3. The tubular water pipe set forth in claim 2 wherein:

said two parts comprise frustums of like cones interconnected at their widest ends.

4. The tubular water pipe set forth in claim 1 wherein:

said heating unit is threaded into said base structure and extends into said first chamber.

5. The tubular water pipe set forth in claim 1 wherein:

said electric switch means being in a normally open position and mounted on the base structure.

6. The tubular water pipe set forth in claim 1 wherein:

said first chamber comprises an air inlet port adjacent said burning unit.

7. The tubular water pipe set forth in claim 1 wherein:

said base structure, first and second chambers and said mouthpiece are all in axial alignment.

8. The tubular water pipe set forth in claim 7 wherein:

said burning unit is mounted outside of said first chamber, and means for connecting the gas of said material to substantially the bottom of said first chamber.

9. The tubular water pipe set forth in claim 1 wherein:

said one-way valve comprises a pair of resilient fingers normally biased together to close the valve and moveable apart to open the valve upon gas being generated in said burning unit.

10. The tubular water pipe set forth in claim 1 wherein:

said valve comprises a resilient sheet-like member biased to normally close said valve and when actuated by suction of a smoker deflects under the pressure of the gas thereagainst to open said valve.

11. The tubular water pipe set forth in claim 1 wherein:

said heating element supports said bowl.

* * * * *